United States Patent [19]

Ueda

[11] 4,014,781

[45] Mar. 29, 1977

[54] METHOD FOR PRODUCING PITCH AND COKE

[75] Inventor: Kozo Ueda, Kyoto, Japan

[73] Assignee: Osaka Gas Company, Ltd., Osaka, Japan

[22] Filed: May 1, 1975

[21] Appl. No.: 573,423

Related U.S. Application Data

[63] Continuation-in-part of Ser. No. 306,050, Nov. 13, 1972, abandoned.

[30] Foreign Application Priority Data

Nov. 27, 1971 Japan ..... 46-95570

[52] U.S. Cl. ..... 208/40; 201/23; 208/126; 423/449

[51] Int. Cl.[2] ..... C10B 55/00; C10G 9/00

[58] Field of Search ..... 208/40, 42, 126; 201/23; 423/449

[56] References Cited

UNITED STATES PATENTS

| | | | |
|---|---|---|---|
| 2,717,865 | 9/1955 | Kimberlin et al. | 208/126 |
| 3,190,812 | 6/1965 | Puls | 208/42 |
| 3,355,377 | 11/1967 | King | 208/40 |
| 3,373,101 | 3/1968 | Folkins et al. | 208/40 |

*Primary Examiner*—Herbert Levine
*Attorney, Agent, or Firm*—Larson, Taylor and Hinds

[57] ABSTRACT

A method for producing pitch and coke which comprises heating a starting oil material in the presence of a powdery carbonaceous substance at a temperature of 350° to 600° C under an increased pressure of at least 2 kg/cm² gauge to produce pitch, coke and oil and separating the pitch and coke from the oil, said starting oil material being distillation residue of crude oil having a Conradson carbon residue of 1 to 25 weight percent and containing 20 to 80 weight percent of substances boiling at a temperature of at least 600° C and less than 10 weight percent of substances boiling at a temperature lower than 350° C, said powdery carbonaceous substance having a Conradson carbon residue of at least 50 weight percent and being added to the starting oil material in such an amount that Conradson carbon residue of the carbonaceous material is in the range of one-tenth to ten times that of the starting oil material.

9 Claims, 1 Drawing Figure

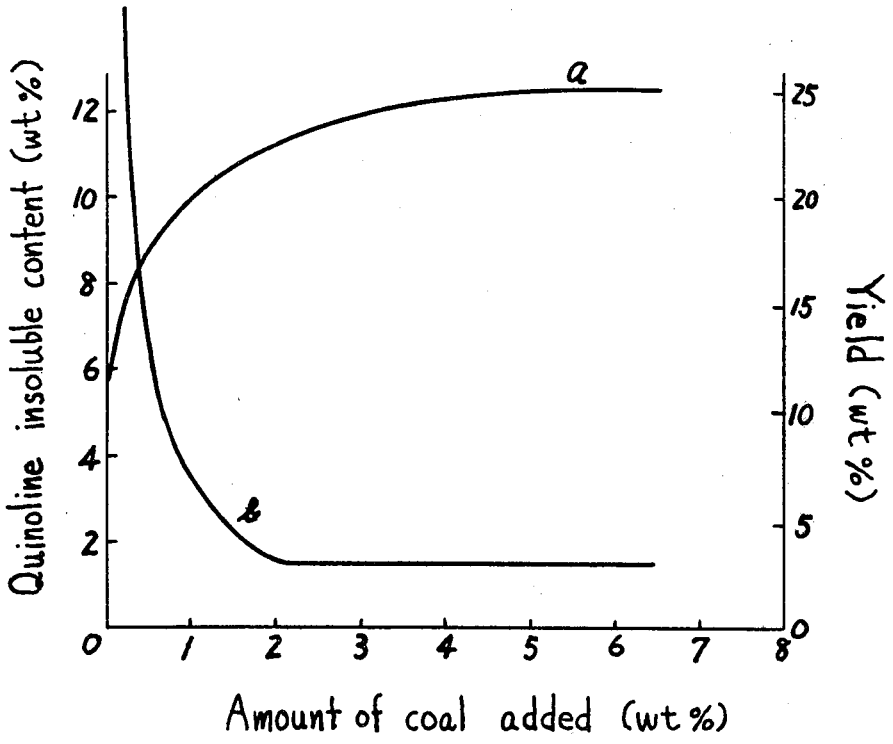
Quinoline insoluble content (wt %)
12
10
8
6
4
2
0
a
b
25
20
15
10
5
0
Yield (wt %)
1
2
3
4
5
6
7
8
Amount of coal added (wt %)

METHOD FOR PRODUCING PITCH AND COKE

This application is a continuation-in-part of our copending application Ser. No. 306,050 filed Nov. 13, 1972 now abandoned.

This invention relates to a method for producing pitch and coke from distillation residue of crude oil containing a considerable amount of high-boiling substances.

According to the conventional method for producing pitch from distillation residue of crude oil, such starting oil material is first subjected to thermal or catalytic cracking at a high temperature of more than 700° C for gasification and thereafter the resultant tarry residue is subjected to heat-soaking conducted at 400 to 500° C to produce pitch.

In this method, however, high-boiling reactive substances contained in the starting oil material are inevitably converted during the cracking step into coke-like substances which adhere to the inner wall of reactor and pipings and reduce the thermal conductivity and capacity of the reactor, this finally making it difficult to continue the operation. Further such coke-like substances are liable to form coarse lumps which will result in the blocking of pipings. These phenomena are so-called "coking trouble". To avoid such coking trouble such coke-like substances are usually removed from the system by burning them during the cracking operation at a specified interval, this not only necessitating complicated procedures but also making it difficult to conduct the cracking operation continuously with a considerable loss of high-boiling reactive substances.

It has been proposed to dilute the starting heavy hydrocarbon feed with about 50 to 100 volume percent of a light distillate of the naphtha boiling range and carry out the coking reaction of the heavy hydrocarbon in the presence of a powdery carbonaceous substance while maintaining the reactants in a state of high turbulence. Although the process substantially eliminates the coking trouble heretofore experienced, it has other serious drawbacks that it is absolutely necessary to carry out the reaction under a highly elevated pressure of about 70 to 210 kg/cm$^2$ so as to maintain the diluent content in the reactor in the order of 50 to 100 volume percent of the total heavy hydrocarbon feed and that the diluent used must be distilled off from the pitch and coke obtained. Further, the pitch produced is of little value due to low softening point and low fixed carbon content.

Various attempts have been made to produce synthetic natural gas by hydrogenated gasification process in which distillation residue of crude oil is subjected to thermal cracking in a hydrogen atmosphere, but a commercially successful method has never been proposed yet, since coking trouble unavoidably occurs as in the case of the aforementioned method.

To overcome the above drawbacks of the conventional methods, the present inventor has conducted various researches and finally developed a novel conception to subject distillation residue of crude oil to heat-treatment to convert high-boiling reactive substances into pitch and coke and subsequently subject the resultant oil to hydrogenated gasification to produce synthetic natural gas. However, various difficulties are encountered in working out this conception.

For example, when distillation residue of crude oil is heated at a high temperature necessary to produce pitch and coke, coking trouble inevitably occurs with poor yield of material oil for hydrogenated gasification. If heat-treatment is carried out at such a low temperature as no coking trouble occurs, an asphalt-like product will be merely obtained without production of pitch. Further, conventional methods to produce coke from the distillation residue of crude oil, such as delayed coker process, are not applicable to the above conceived method, since oil is obtained only in a low yield and contains a considerable amount of undesired aromatic components.

According to further researches of the present inventor it has been unexpectedly found that, when distillation residue of crude oil is heated in the presence of a powdery carbonaceous substance under an increased pressure at a relatively low temperature, pitch, coke and oil are produced completely free from any coking trouble, with the result that the pitch and coke produced can easily be separated from each other and the oil obtained can effectively be subjected to hydrogenated gasification to produce synthetic natural gas without coking trouble.

An object of the invention is accordingly to provide a method for producing pitch, coke and oil respectively in high yields free from any coking trouble by direct heat-treatment of distillation residue of crude oil.

Another object of the invention is to provide a method for producing pitch and coke directly from distillation residue of crude oil, in which the resultant pitch and coke produced can easily be separated from each other by conventional separation procedures.

Another object of the invention is to provide a process for producing pitch which has a high softening point and a large Conradoson carbon residue and which is therefore useful as an additive to coking coal charge for producing coke.

Another object of the invention is to provide a process for producing coke in the form of particles, which causes no coking trouble and can be used as an additive to coking coal charge for producing coke.

Another object of the invention is to provide a process for producing pitch which contains a considerable amount of a $\beta$-resin component, i.e., a component insoluble in benzene but soluble in quinoline, and which is therefore effectively employable as an electrode binder.

These and other objects of the invention will be apparent from the following description.

The process of the invention comprises heating a starting oil material in the presence of a powdery carbonaceous substance at a temperature of 350 to 600° C under an increased pressure of at least 2 kg/cm$^2$ gauge to produce pitch, coke and oil and separating pitch and coke from oil, said starting oil material being distillation residue of crude oil having a Conradson carbon residue of 1 to 25 weight percent and containing 20 to 80 weight percent of substances boiling at a temperature of at least 600° C and less than 10 weight percent of substances boiling at a temperature lower than 350° C, said powdery carbonaceous substance having a Conradson carbon residue of at least 50 weight percent and being added to the starting oil material in such an amount that Conradson carbon residue of the carbonaceous material is in the range of one-tenth to ten times that of the starting oil material.

According to the present invention pitch and coke are produced respectively in high yields completely free from any coking trouble and the resultant pitch and coke can easily be separated from each other by a conventional separation procedure such as filtration, precipitation, centrifugation and the like. Thus, the method of the present invention makes it possible for the first time to produce pitch directly from distillation residue of crude oil, whereas such direct production of pitch from the distillation residue has been believed to be impossible in the prior art, since the high boiling substances contained in the starting material results in the formation of coke which is difficult to separate from pitch with undesired coking trouble. The reason why the direct production of pitch from distillation residue of crude oil is possible in accordance with the present invention has not been made clear yet. However, it may be attributable to the fact that the powdery carbonaceous substance added to the reaction system selectively adsorbs coke produced by the reaction and exhibits catalytic action on coking reaction of the starting material, enabling the production of coke in the granular form. In fact, the powdery carbonaceous substance used substantially grows in dimensions due to selective adsorption of coke produced and the yield of the coke increases a great deal as compared with the case wherein the carbonaceous substance is not employed.

Moreover, the pitch obtained by the above method of the invention contains extremely small amount of benzene-insolubles and almost no quinoline-insolubles but has a high softening point and a large Conradson carbon residue with highly homogeneous property as compared with asphalt. Therefore, the pitch can effectively be used as an additive to coking coal charge for producing coke and as an impregnating agent for electrode and the like. "Conradson carbon residue" is determined in accordance with ASTM D-189 and hereinafter referred to as "carbon residue". Further the coke obtained in the present invention can also be used as an additive to coking coal charge for producing coke. Moreover, the present method makes it possible to obtain oil in a high yield, since the amount of gas produced during the heat-treatment is markedly reduced as compared with the conventional methods. Further, the resultant oil can effectively be subjected to hydrogenated gasification to produce synthetic natural gas without any coking trouble.

In the invention distillation residues obtained by distillation of a crude oil under atmospheric or reduced pressures is used as a starting oil material. The distillation residue to be used has a carbon residue of 1 to 25 weight percent and contains 20 to 80 weight percent of high boiling substances having a boiling point of at least 600° C and less than 10 weight percent of low boiling substances having a boiling point of lower than 350° C. If the carbon residue is less than 1 weight percent, the yields of pitch and coke will be lowered, while separation of pitch and coke will be difficult when the carbon residue is more than 25 weight percent. Further, the same undesirable results as above are obtained when the starting oil material contains less than 20 weight percent or more than 80 weight percent of high boiling substances having a boiling point of at least 600° C. When the starting oil material contains more than 10 weight percent of low boiling substances having a boiling point of lower than 350° C, the reaction to produce pitch and coke is retarded due to the dilution of reactants, and the pitch obtained will have low softening point and low fixed carbon content, hence of little value. Preferable distillation residue of crude oil to be used as a starting material are those having a carbon residue of 5 to 20 weight percent and containing 25 to 65 weight percent of high boiling substances boiling at a temperature of at least 600° C and less than 5 weight percent of low boiling substances boiling at a temperature of lower than 350° C.

In accordance with the method of the invention it is essential to add a powdery carbonaceous substance to the reaction system. The carbonaceous substances to be used in the invention include those which have a carbon residue of at least 50 weight percent and which can retain solid state under the conditions applied in the heat-treatment step of the invention. Examples thereof are powders of coal, coke, graphite, active carbon, carbonized resin and the like. Spent active carbon can be used as it is without adverse effect. Particularly preferable are coal dust and coke dust. The coke obtained by the present method can be used by recirculation as the carbonaceous substance. The particle size of the powdery carbonaceous material may vary over a wide range. For example, a small powder having a particle size of less than 50$\mu$ and a large one having a particle size of 5 mm can be used in the invention respectively. However, carbonaceous substance having a particle size of not more than 5 mm can effectively be used in the invention. Particularly preferable particle size is in the range of 50 $\mu$ to 1 mm.

The powdery carbonaceous substance can be added to the starting oil material in such an amount that the carbon residue contained in the carbonaceous substance is in the range of one-tenth to ten times that of the starting oil material. When the amount is less than the lower limit, not only coking trouble is liable to occur but also separation of pitch and coke may be difficult, whereas when the amount is more than the upper limit, stirring of the reaction system is difficult without any improved effect. Preferable amount in terms of carbon residue of the carbonaceous material is in the range of one-fifth to five times the carbon residue of the starting oil material. When the carbonaceous substance is used in the above preferable range, pitch and coke can be produced in high yields and pitch contains less quinoline-insolubles.

According to the method of the invention the specified starting oil material is heated in the presence of the powdery carbonaceous substance at an elevated temperature under an increased pressure to produce pitch, coke and oil. The temperature applied is in the range of 350° to 600° C. If the temperature is lower than 350° C, the yields of pitch and coke will be reduced, while temperatures higher than 600° C increase not only the production of gas but also the concentration of coke in the reaction system, making it difficult to conduct the reaction continuously. Preferable reaction temperature is in the range of 380° to 510° C. The heat-treatment is carried out under an increased pressure of at least 2 kg/cm$^2$ gauge, which permits reactive substances in the starting oil material to remain in the reaction system in the form of liquid and to react with one another effectively to produce pitch and coke in high yields. High order of pressure is applicable in the invention but it is preferable to conduct the heat-treatment at an increased pressure of not higher than 70 kg/cm$^2$ gauge, since pressures higher than 70 kg/cm$^2$ gauge necessitate a large and expensive apparatus and further hinder the distillation off of the undesirable low boiling substances. Preferable reaction pressure is in the range of 5 to 50 kg/cm$^2$ gauge. The heat-treatment can be carried out with or without stirring by a batch method or in a continuous manner. Although the time for heat-treatment is widely variable with the temperature at which the reaction is conducted, etc., it is usually 1 minute to 30 hours.

the resultant pitch and coke components thus produced can easily be separated by a simple procedure conventional in the art, for example, by filtration, precipitation, centrifugation or a combination thereof. For example, the reaction mixture is subjected to any one of the above separation methods to separate coke from a mixture of pitch and oil, and the pitch is then separated from the oil by distillation. The separated coke has excellent coking property similar to that of coking coal and therefore can be used as an additive to coking coal charge for producing coke. Further, the coke obtained is in the form of loose particles and by activation thereof granular active carbon can be produced therefrom. If spent active carbon is used as an carbonaceous substance in the invention, it will be regenerated by activation conducted after the present heat-treatment. To increase carbon residue of the coke obtained in the present method, it can be washed with light oil obtained by distillation of crude oil. The pitch obtained is of homogeneous properties and contains very small amount of benzene-insolubles and almost no quinoline-insolubles but has a higher softening point and larger content of carbon residue than those of conventional asphalts. Therefore, it can effectively be used as an additive to coking coal charge for producing coke and as an impregnating agent for electrode and the like. Since pitch and coke obtained by the present method can be used as an additive to coking coal charge for producing coke, there is no need to separate them from each other for this use.

In the above method, the ratio of pitch to coke to be produced can be adjusted fairly freely by suitably controlling the reaction temperature, reaction pressure and reaction time in accordance with the kind and composition of the starting oil materials.

The heat-treatment of the invention makes it possible to obtain not only useful pitch and coke but also oil having improved properties. That is to say, the oil obtained by the present method is lightened during the reaction under increased pressure, unstable components contained in the starting material are reacted into pitch and coke, and further sulfur contained in the starting material is removed as hydrogen sulfide gas. Thus, the oil obtained in combination with the above-mentioned improved pitch and coke can effectively be used as a low-sulfur fuel gas or as a material oil for gasification. For example, when the oil obtained by this method is subjected to hydrogenated gasification, synthetic natural gas having a high calorific value can be obtained free from coking trouble. For the purposes of improving the yields of pitch and coke and producing more useful light oil fraction, the oil obtained as above can be added to the starting oil material. The oil obtained per se or a fraction obtained by heat-treatment and distillation thereof may be added to the starting oil material. The amount and the boiling range of the oil to be recycled to the starting oil material are widely variable in so far as the properties of the starting material are in the specified range. However, the oil to be recycled has preferably a boiling point not lower than 350° C for substantially improving the total yields of pitch and coke.

Moreover, further research of the present inventor reveals the fact that, when the pitch thus obtained is subsequently subjected to a heat-treatment which is carried out at an elevated temperature under increased pressure, the content of $\beta$-resin component in the pitch increases markedly, making it possible to obtain an improved pitch which can be used as an electrode binder. The pitch obtained by this method has the following properties:

| | |
|---|---|
| Softening point | 60 to 120° C |
| Carbon residue | 50 to 65 wt.% |
| Benzene-insolubles | 20 to 36 wt.% |
| Quinoline-insolubles | 5 to 12 wt.% |

The reaction temperature applied is in the range of 350° to 510° C, preferably 380° to 450° C. The reaction pressure may vary over a wide range in accordance with the properties of pitch to be obtained, but usually it is in the range of 2 to 35 kg/cm$^2$ gauge, preferably 5 to 25 kg/cm$^2$ gauge.

In this second heat-treatment step there is no need to use carbonaceous substance, since high boiling reactive substance which will cause coking trouble has already been converted into pitch and/or coke in the first heat-treatment step. Further, the pitch to be used as a starting material in the second heat-treatment step can contain a considerable amount of oil, and therefore a pitch having a low softening point of at least 10° C can be used for the purpose.

For a better understanding of the invention examples are given below, in which all parts and percentages are by weight unless otherwise specified. Further, FIG. 1 referred to in Example 2 is a graph showing the relations of the amount of powdery carbonaceous substances used to the yield of pitch and coke and to quinoline-insoluble content in the pitch.

EXAMPLE 1

To 500 parts of a topped Minas crude oil having a carbon residue of 5.4% and containing 50% of substances having a boiling point of at least 600° C and 4% of substances having a boiling point of lower than 350° C was added 32.5 parts of coal dust having a carbon residue of 70.6% and pulverized to a particle size of less than 74$\mu$, and the mixture was charged in a 1-liter autoclave equipped with a stirrer and maintained at 420° C for 5 hours under a pressure of 20 kg/cm$^2$ gauge, with the result that 39 parts of gas was generated.

After cooling, the autoclave was found to contain fine solid particles suspended in a solution of relatively low viscosity, with the wall of vessel and the blades of stirrer free of deposition of coking product which takes place when no coal is used.

The product was filtered through a 60-mesh screen to obtain 129 parts of coke in the form of solid particles and 365.5 parts of a solution. 365.5 parts of the solution was distilled until the distillation temperature reached 300° C under a reduced pressure (5 mm Hg) to obtain 330 parts of light oil and 35.5 parts of pitch. The properties of the pitch are shown in Table 1 below.

COMPARISON EXAMPLE 1

Reaction was carried out under the same conditions as in Example 1 except that no coal dust was added. It was found that a large amount of coke-like substance was deposited on the wall of reactor and the blades of stirrer, with a lump of coke-like substance produced at the bottom of reactor. The product could not be separated into solid and solution, unlike the product resulting from use of coal. The product thus obtained was directly subjected to distillation under the same conditions as in Example 1 to obtain pitch containing coke-like substance. The properties of the pitch are shown in Table 1 below.

COMPARISON EXAMPLE 2

Reaction was carried out as in Example 1, with the exception that no coal dust was added and the heat-treatment was conducted at a lower temperature of 340° C at 10 kg/cm² gauge for 10 hours to preclude formation of coking product. The product obtained in the form of a homogeneous solution was directly subjected to distillation under the same conditions as in Example 1 to prepare an asphalt-like substance, the properties of which are shown in Table 1 below.

Table 1

| | | Yield (wt.%) | Properties QI (%) | BI (%) | CCR (%) | Softening point (° C) | S (%) |
|---|---|---|---|---|---|---|---|
| Ex. 1 | Pitch | 7.1 | 0.0 | 0.6 | 38.7 | 59.5 | <0.2 |
| | Solid | 25.8 | 50.7 | 47.5 | 49.1 | Un-measurable | <0.2 |
| Comp. Ex. 1 | Coke-containing pitch | 11.3 | 19.1 | 19.7 | 44.5 | Un-measurable | <0.2 |
| Comp. Ex. 2 | Asphalt-like substance | 38.0 | 0.0 | 0.0 | 8.9 | 35.0 | <0.2 |

The symbols QI, BI, CCR and S described above represent the following and the softening point was determined by the Mercury method set forth in JISK 2421-66. The yield was based on the topped crude oil.

QI(%): Quinoline-insoluble content
BI(%): Benzene-insoluble content
CCR(%): Conradson carbon residue
S(%): Sulfur content

EXAMPLE 2

To 500 parts of a topped Minas crude oil the same as in Example 1 was added a predetermined amount of the same coal dust as in Example 1 and the mixture was charged in a 1-liter autoclave equipped with a stirrer and maintained at 400° C for 5 hours under a pressure of 20 kg/cm² gauge. The resultant reaction product was treated in the same manner as in Example 1 to separate pitch and coke from each other.

The relations of the amount of coal dust used to the yield of the pitch and coke and to the quinoline-insolubles contained in the pitch are shown in FIG. 1. Curve (a) in FIG. 1 shows the yield of pitch and coke, and curve (b) shows the quinoline-insolubles contained in pitch.

It will be apparent from FIG. 1 that as the amount of coal dust added increases, the yields of pitch and coke increase and the amount of the quinoline-insolubles of the pitch decreases. The small amount of the quinoline-insolubles of the pitch means that the pitch can be separated from coke satisfactorily.

EXAMPLE 3

Residue obtained from Gach-saran crude oil by vacuum distillation was used as a starting material. The residue had a carbon residue of 15.6% and contained 63.0% of substances having a boiling point of at least 600° C and 37.0% of substances boiling between 350° to 600° C. To 500 parts of the residue was added 70 parts of coke dust having a carbon residue of 99.1% and pulverized to a particle size of less than 200μ, and the mixture was charged in a 1-liter autoclave equipped with a stirrer and maintained at 410° C for 5 hours under a pressure of 20 kg/cm² gauge, whereby 27.5 parts of gas was generated. The internal state of the autoclave after cooling was approximately the same as in Example 1. The product thus obtained was filtered through a 60-mesh screen to obtain 240 parts of solid particles and 302.5 parts of a homogeneous solution. 234.5 parts of the solution was taken from the solution and was distilled until the distillation temperature reached 250° C under a reduced pressure (5 mm Hg) to obtain 125 parts of light oil and 177.5 parts of pitch. The properties of the pitch and the solid thus obtained were as follows:

| | | |
|---|---|---|
| Pitch | Quinoline-insolubles | 0.1% |
| | Benzene-insolubles | 0.3% |
| | Conradson carbon residue | 38.4% |
| | Softening point (Mercury method) | 51.0° C |
| Solid | Quinoline-insolubles | 60.0% |
| | Benzene-insolubles | 59.0% |
| | Conradson carbon residue | 66.0% |

EXAMPLE 4

To 500 parts of a commercially available asphalt having carbon residue of 20.0% and containing 57.3% of substances having a boiling point of at least 600° C and substantially free from substances boiling lower than 350° C was added 35 parts of coal powder having a carbon residue of 91.2% and pulverized to a particle size of less than 200μ, and the mixture was charged in an autoclave equipped with a stirrer and maintained at 395° C for 5 hours under a pressure of 8 kg/cm² gauge, with the generation of 6 parts of gas.

The amounts of pitch, coke and oil recovered from the product in the same manner as in Example 1, and the properties of the pitch are given in Tables 2 and 3, respectively.

COMPARISON EXAMPLE 3

Reaction was carried out in the same manner as in Example 4 except that a mixture consisting of 250 parts of the asphalt used in Example 4 and 250 parts of naphtha having specific gravity of 0.76 and end point of 170° C was used as the starting material and that the reaction pressure was 90 kg/cm² gauge.

The amounts of pitch, coke, oil and gas are shown in Table 2 below and the properties of the pitch in Table 3.

Table 2

| | | | Ex. 4 | Comp. Ex. 3 |
|---|---|---|---|---|
| Products obtained (% : based on the weight of starting material) | Oil produced | Oil distilled off during reaction | 15 | 0 |
| | | Boiling lower than 200° C | 10 | 54 |
| | | Boiling between 200 – 500° C | 23 | 15 |
| | Pitch | | 24 | 18 |
| | Coke | | 22 | 9 |
| | Gase | | 6 | 4 |

Table 3

| | | Ex. 4 | Comp. Ex. 3 |
|---|---|---|---|
| Properties of pitch produced | Softening point (Hg method) (° C) | 85.1 | 41.1 |
| | Conradson carbon residue (%) | 45.4 | 29.2 |

EXAMPLE 5

2270 parts of Murban crude oil was distilled to remove light fraction boiling at a temperature lower than 350° C, whereby 1000 parts of topped crude oil having a carbon residue of 5.5% and containing 26.1% of substances having a boiling point more than 600° C was obtained. To the resultant topped crude oil was added 70 parts of coal dust having a carbon residue of 92.8% and particle size of less than 250$\mu$. The mixture was placed in a 50-liter autoclave equipped with a stirrer and heated at 410° C for 5 hours under a pressure of 20 kg/cm² gauge, with the result that 55 parts of gas was generated. The internal state of the autoclave after cooling was the same as in Example 1. The product was filtered through a 100-mesh screen to obtain 340 parts of coke as solid particles and 675 parts of filtrate as a homogeneous solution. The solid particles had a carbon residue of 59.5% and contained 60.2% of benzene-insolubles and 60.3% of quinoline-insolubles. The coke particles were washed with light oil obtained by the above distillation of the crude oil to obtain by the above distillation of the crude oil to obtain 237 parts of washed coke particles having a carbon residue of 85.0% and containing 86.2% of benzene-insolubles and 86.3% of quinoline-insolubles.

The light oil used was mixed with the filtrate obtained above and the mixture was distilled under reduced pressure to produce 1916 parts of oil and 72 parts of pitch having the following properties.

| | |
|---|---|
| Softening point: | 88.2° C |
| Carbon residue: | 51.6% |
| Benzene-insolubles: | 1.7% |
| Quinoline-insolubles: | 0.1% |

-continued

| The oil obtained had the following properties: | |
|---|---|
| Atomic molar ratio H/C: | 1.97 |
| Carbon residue: | 0% |
| Content of aromatics: | 26.3% |
| Content of olefins: | 2.6% |
| Content of paraffins and naphthenes: | 71.0% |

Coking property of the resultant pitch was tested by modified Roga Index testing method as follows:

Predetermined amounts of the resultant pitch was mixed with semi-coking coal and 40 parts of the mixture was added to 60 parts of pulverized coke dust having a particle size less than 0.25 mm. The resultant mixture was placed in a crucible having dimensions of 38 mm in inner diameter and 32 mm in depth and pressed with a load of 10 kg for 30 minutes. Thereafter, the mixture was heated under a load of 120 g at 850° C for 20 minutes to produce coke. The strength of the resultant coke was determined by ISO/TC-27-146E (1953) with the results shown in Table 4 below. In Table 4 are also shown the results obtained in the same manner as above except tht coal tar pitch produced by conventional air-blown method was used in place of the present pitch. The above comparative pitch had a softening point of 116° C and contained 13.7% of quinoline-insolubles and 40.8% of benzene-insolubles.

Table 4

($RI_1^{250}$)

| Pitch used | Amount of pitch (%/coke) 0 | 10 | 20 | 30 |
|---|---|---|---|---|
| Present pitch | 72 | 83 | 87 | 89 |
| Comparative pitch | 72 | 76 | 80 | 80 |

Further, the following gasification tests where conducted using the oil obtained in Example 5.

The oil obtained in Example 5 was subjected to hydrogenated gasification conducted under the conditions specified below in a tubular reactor having an inner diameter of 30 mm.

| Conditions for gasification | |
|---|---|
| Temperature | 775° C |
| Pressure | 48.5 kg/cm² gauge |
| Resident time | 4.8 seconds |
| Oil/$H_2$ ratio | 1.45 g/l |

The results are shown in Table 5 below, in which are also shown the results obtained by using Murban crude oil used in Example 5. The crude oil had an atomic ratio of H/C of 1.90 and a carbon residue of 1.80%.

Table 5

| | | Present oil | Crude oil |
|---|---|---|---|
| Yield of products (%) | Gas | 72.1 | |
| | Condensate | 28.4 | |
| | Carbon | 0.5 | More than 25% |
| Composition of the gas obtained (Vol.%) | $H_2$ | 18.1 | Unmeasurable * |
| | $CH_4$ | 54.2 | |
| | $C_2H_6$ | 24.3 | |
| | Others | 3.4 | |

Table 5-continued

| | Present oil | Crude oil |
|---|---|---|
| Gross calorific value (Kcal/Nm³) | 10500 | |

Note:
* When crude oil was used, carbon was produced in a large amount more than 25% hence unmeasurable.

EXAMPLE 6

A fraction having no carbon residue content and consisting essentially of substances boiling at 350° to 500° C was recovered by subjecting the oil obtained in Example 4 to vacuum distillation at 5 mm Hg. A mixture consisting of 400 parts of the asphalt used in Example 4 and 100 parts of the recovered fraction was prepared, which had a Conradson carbon residue of 16% and contained 45.8% of substances boiling at a temperature at least 600° C and 54.2% of substances boiling at 350° to 600° C. To the mixture was added 35 parts of the coal powder as used in Example 4, and the resultant mixture was reacted in the same manner as in Example 4.

The amounts of pitch, coke, oil and gas recovered, and the properties of the pitch are given in Tables 6 and 7, respectively.

Table 6

| | | | |
|---|---|---|---|
| Products obtained (%: based on the weight of starting material) | Oils produced | Boiling lower than 200° C | 32.7 |
| | | Boiling between 200 – 500° C | 10.3 |
| | Pitch | | 27.6 |
| | Coke | | 22.0 |
| | Gase | | 7.4 |

Table 7

| | | |
|---|---|---|
| Properties of pitch produced | Softening point (° C) | 98.3 |
| | Conradson carbon residue (%) | 51.7 |

What I claim is:

1. A method for producing high yields of coke and pitch without coking trouble by direct heat-treatment of a distillation residue of crude oil, said pitch having a high softening point and a high Conradsen carbon residue and said pitch and coke being useful as an additive to coking coal charge for producing coke which method comprises heating a starting feed selected from the group consisting essentially of a distillation residue of crude oil alone or together with a minor amount of recycle oil produced by the method having a boiling point not lower than 350° C in the presence of a powdery carbonaceous substance at a temperature of 350° to 600° C under an increased pressure of 5 to 50 kg/cm² gauge to produce pitch, coke and oil and separating the pitch and coke from the oil, said starting oil material being distillation residue of crude oil having a Conradsen carbon residue of 1 to 25 weight percent and containing 20 to 80 weight percent of substances boiling at a temperature of at least 600° C and less than 10 weight percent of substances boiling at a temperature lower than 350° C, said powdery carbonaceous substance having a Conradsen carbon residue of at least 50 weight percent and being added to the starting oil material in such an amount that Conradsen carbon residue of the carbonaceous material is in the range of one-tenth to ten times that of the starting oil material.

2. The method according to claim 1, in which said starting oil material is distillation residue of a crude oil having a Conradson carbon residue of 5 to 20 weight percent and containing 25 to 65 weight percent of high boiling substances boiling at a temperature of at least 600° C and less than 5 weight percent of low boiling substances boiling at a temperature of lower than 350° C.

3. The method according to claim 1, in which said carbonaceous substance is at least one powder selected from the group consisting of coal, coke, graphite, active carbon and carbonized resin powders.

4. The method according to claim 3, in which said carbonaceous substance is at least one powder selected from the group consisting of coal and coke powders.

5. The method according to claim 1, in which said powdery carbonaceous substance has a particle size of not more than 5 mm.

6. The method according to claim 5, in which said particle size is in the range of 50$\mu$ to 1 mm.

7. The method according to claim 1, in which said powdery carbonaceous substance is added to the starting oil material in such an amount that Conradson carbon residue of the carbonaceous substance is in the range of one-fifth to five times that of the starting oil material.

8. The method according to claim 1, in which said heat-treatment is conducted at a temperature of 380° to 510° C.

9. Coke obtained by the method of claim 1.

* * * * *